US007604397B2

(12) United States Patent
Cohen

(10) Patent No.: US 7,604,397 B2
(45) Date of Patent: Oct. 20, 2009

(54) SEALING DEVICE FOR WATCH CROWN

(76) Inventor: Raphaël Cohen, c/o Ravène SA, Place du Molard 9, Geneva (CH) 1204

( * ) Notice: Subject to any disclaimer, the term of this patent is extended or adjusted under 35 U.S.C. 154(b) by 410 days.

(21) Appl. No.: 11/573,480

(22) PCT Filed: Dec. 8, 2004

(86) PCT No.: PCT/IB2004/004061

§ 371 (c)(1),
(2), (4) Date: Feb. 9, 2007

(87) PCT Pub. No.: WO2006/061674

PCT Pub. Date: Jun. 15, 2006

(65) Prior Publication Data

US 2009/0067297 A1 Mar. 12, 2009

(51) Int. Cl.
*G04B 29/00* (2006.01)
*G04B 37/00* (2006.01)

(52) U.S. Cl. ..... 368/288; 368/308

(58) Field of Classification Search ..... 368/147, 368/190, 288–290, 308, 319–321
See application file for complete search history.

(56) References Cited

U.S. PATENT DOCUMENTS

| | | | | |
|---|---|---|---|---|
| 1,521,208 | A * | 12/1924 | Von Kersburg | 368/106 |
| 2,954,665 | A * | 10/1960 | Maria | 368/289 |
| 6,200,019 | B1 * | 3/2001 | Latini | 368/289 |
| 6,210,034 | B1 * | 4/2001 | Latini | 368/289 |
| 6,679,624 | B1 * | 1/2004 | Mouawad | 368/216 |
| 7,001,064 | B2 * | 2/2006 | Finazzi | 368/319 |

FOREIGN PATENT DOCUMENTS

| | | | |
|---|---|---|---|
| FR | 2113765 | * | 6/1972 |
| GB | 364878 | * | 1/1932 |

* cited by examiner

*Primary Examiner*—Vit W Miska
(74) *Attorney, Agent, or Firm*—Galbreath Law Offices, P.C.; John A. Galbreath

(57) ABSTRACT

A sealing device (1) for a watch crown that includes a cover (2) possessing an annular part (3) that fits and rests on the periphery of a cabochon (4) of a watch crown (5) against a seal (6). Said cover (2), which is articulated on one of the shoulders (7) protecting the crown (5) of a watchcase (8) has, at its end, a closure lug (9). The latter is designed to receive a buckle (10) integral with a fastening arm (12). This fastening arm (12) makes it possible for the cover (2) to exert sufficient pressure on said seal (6) by means of a simple lever effect when the end of the fastening arm (12) is inserted into a receptacle (15).

8 Claims, 2 Drawing Sheets

SEALING DEVICE FOR WATCH CROWN

The present invention relates to the field of horology and more particularly to a visible device that may have an original esthetic appearance while guaranteeing optimum sealing of a watch crown.

Various systems to guarantee the seal of a watch crown are already part of the prior art. The majority of systems make use of sealing means arranged in the middle of a watchcase. The screwed crown is a principle that is widely used in the case of diving watches. U.S. Pat. No. 5,383,166 describes a system of this type, which consists in screwing the crown onto a screw thread provided on the external lateral face of a tube screwed into the middle of the watchcase, thus compressing a seal arranged in said crown and sealing the latter.

DE 10109881 discloses a watch crown whose seal is reinforced by means of a fastening device exerting axial pressure on said crown. This device, integral with the watch rim, may be displaced axially relative to the center of the watch using said rim as a guide so as to be able to come into position opposite the crown.

A sealing device consisting, on the one hand, of a cover having an end articulated on a shoulder protecting a watch crown and, on the other hand, of a small buckle articulated on the other shoulder protecting said crown is also part of the prior art. However, the small dimensions of the cover and small buckle require awkward manipulation and do not exert significant pressure on the crown.

The object of the present invention is to present a sealing device that allows easy manipulation when opening and closing it and that provides significant pressure on the crown so as to guarantee maximum sealing.

This object is achieved by virtue of a sealing device as claimed in claim 1, comprising a fastening arm integral with the buckle, which allows, on the one hand, simplification of closing and opening the sealing system by means of simple manipulation and, on the other hand, sufficient pressure to be exerted on the crown, said fastening arm acting as a lever. This system may be fitted to a watch that includes a screwed crown in order to achieve, on the one hand, an esthetic original appearance, and, of other of part, doubly secure sealing.

One embodiment of the invention will now be described by way of example with reference to the diagrammatic figures, in which.

Figure 1:
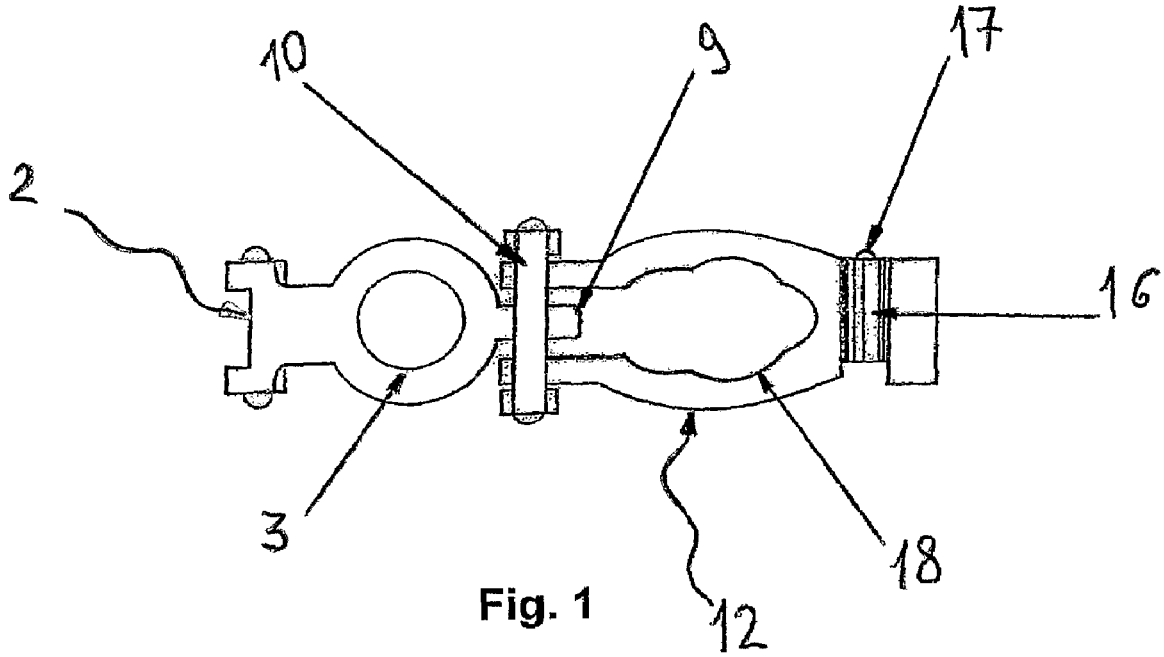
FIG. 1 shows a plan view of a sealing device (1) alone, including a cover (2) and a fastening arm (12) in the closed position.
Figure 2:
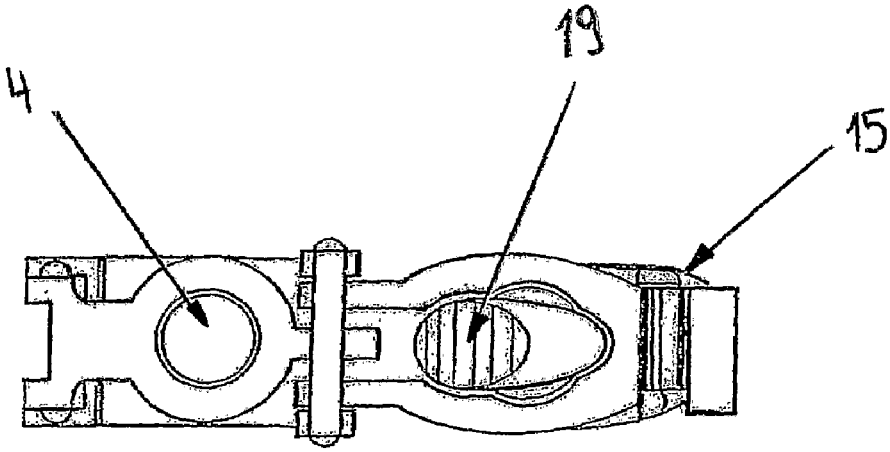
FIG. 2 shows a plan view of the sealing device (1), positioned on the crown (5) of a watchcase (8), in the closed position.
Figure 3:
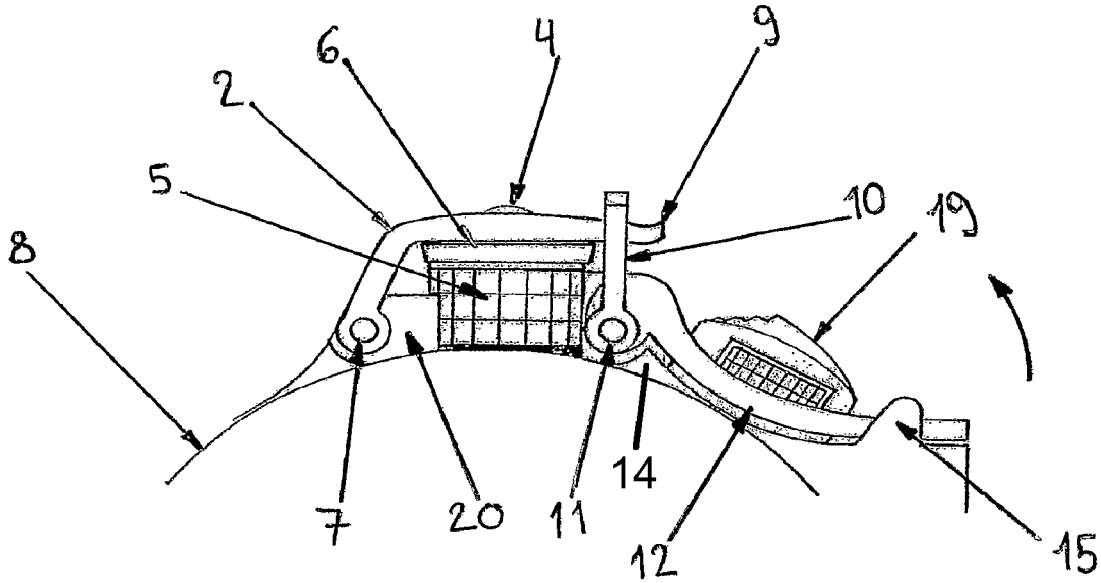
FIG. 3 shows a side view of the sealing device (1), positioned on the crown (5) of the watchcase (8), in the closed position.
Figure 4:
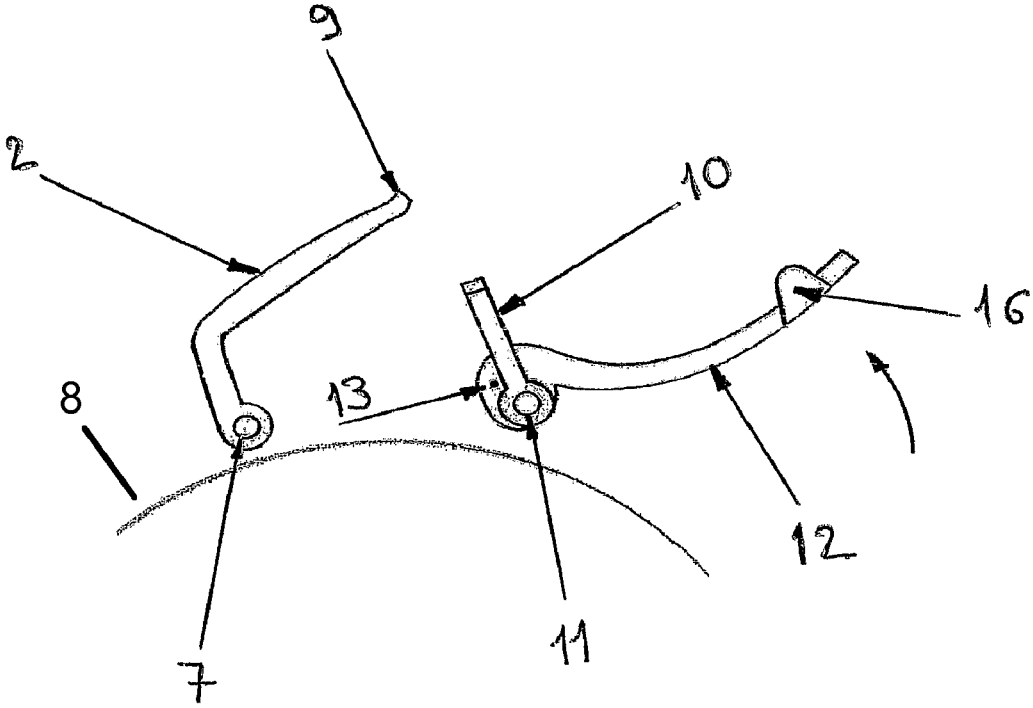
FIG. 4 shows a side view of the sealing device (1) alone in the open position.

According to this embodiment of the invention, said sealing device (1) includes a cover (2) possessing an annular part (3) and a fastening arm (12). The annular part (3) of said cover (2) fits and rests on the periphery of a cabochon (4) of a watch crown (5), against a seal (6). Said cover (2) pivots on a first axis (7) by virtue of two pivots chased in on either side of one of the shoulders (20) protecting the crown (5) of a watchcase (8).

A closure lug (9) is located on the end of the cover (2). This lug (9) is designed to receive a buckle (10) that pivots on a second axis (11) by virtue of two other pivots chased in on either side of the base of the fastening arm (12). The fastening arm (12) itself pivots on a rod passing through the other shoulder (14) protecting said crown (5) at the height of a third axis (13), the second axis (11) being off-center relative to the pivot point of said arm (12).

When the fastening arm (12) of the sealing device is detached from the watchcase (8), the pivoting of said arm (12) on the third axis (13) raises the second axis (11) relative to the watchcase (8) and this causes the buckle (10) to be raised so that it is possible to detach said buckle (10) from the closure lug (9).

This device (1) makes it possible on the one hand freely to adjust said buckle (10) on the closure lug (7) when the cover (2) is positioned on the periphery of said cabochon (4) and, on the other hand, to exert sufficient pressure on the seal (6) through the lever effect when the end of the fastening arm (12) is inserted in a receptacle (15).

The end of the fastening arm (12) has a domed part (16) in which a sprung ball (17) is arranged for the purpose of being inserted in a cavity of the receptacle (15) so as firmly to hold the fastening arm (12) in said receptacle (15).

The fastening arm (12) has, at its center, a cut-out (18) that is profiled so as to be able to receive the contour of a push-button (19) when said fastening arm (12) is arranged in the receptacle (15).

The invention claimed is:

1. A sealing device (1) designed to be positioned on a watch crown (5), arranged on two shoulders (14,20) protecting said crown (5) of a watchcase (8), the device (1) comprising, on the one hand, a cover (2) possessing an annular part (3) that fits and rests on the periphery of a cabochon (4) of the crown (5) against a seal (6), said cover (2) including at its end a closure lug (9) and pivoting on a first axis (7) located on one of the shoulders (20) protecting the crown (5), the sealing device (1) including, on the other hand, a buckle (10) for the closure of the cover (2), characterized in that said buckle (10) pivots on a second axis (11) located on a fastening arm (12), said fastening arm (12) pivoting on a third axis (13) and located on the other shoulder (14) protecting the crown (5) of the watchcase (8) such that the device (1) is in the closed position when, on the one hand, said buckle (10) and the cover (2) are, respectively, positioned on the lug (9) and the periphery of said cabochon (4), and, on the other hand, the fastening arm (12) is arranged against the watchcase (8), the device (1) being in the open position when the end of the fastening arm (12) and the buckle (10) are, respectively, detached from the watchcase (8) and the closure lug (9), enabling the cover (2) to be disengaged from the crown (5) of the watchcase (8).

2. The sealing device (1) as claimed in claim 1, characterized in that the fastening arm (12) is arranged so as to be retained in a receptacle (15) of the watchcase (8) in the closed position.

3. The sealing device (1) as claimed in claim 2, characterized in that the end of the fastening arm (12) has a part (16) in which a sprung ball (17) is arranged for the purpose of being inserted in a cavity of said receptacle (15).

4. The sealing device (1) as claimed in claim 2, characterized in that the fastening arm (12) has a cavity (18) that is profiled so as to be able to receive the contour of a push-button (19) when the end of the fastening arm (12) is positioned in the receptacle (15).

5. A watch that includes a sealing device (1) as claimed in claim 1.

6. A watch that includes a sealing device (1) as claimed in claim 2.

7. A watch that includes a sealing device (1) as claimed in claim 3.

8. A watch that includes a sealing device (1) as claimed in claim 4.

* * * * *